US006874630B2

(12) United States Patent
Lin Wu

(10) Patent No.: US 6,874,630 B2
(45) Date of Patent: Apr. 5, 2005

(54) SUSPENSION PLATE FOR A TOOL

(76) Inventor: Li-Tu Lin Wu, No. 367, Sec. 1, Mei-Tsun Rd., Taichung (TW)

( * ) Notice: Subject to any disclaimer, the term of this patent is extended or adjusted under 35 U.S.C. 154(b) by 221 days.

(21) Appl. No.: 10/383,034

(22) Filed: Mar. 6, 2003

(65) Prior Publication Data

US 2004/0173486 A1 Sep. 9, 2004

(51) Int. Cl.[7] ..... A47F 7/00
(52) U.S. Cl. ..... 206/349; 248/309.1
(58) Field of Search ..... 206/349, 361, 206/63, 371, 372, 376, 379, 553; 248/110, 113, 309.1, 311.3, 312

(56) References Cited

U.S. PATENT DOCUMENTS 4,400,023 A * 8/1983 Clarke ..... 285/302
4,729,473 A * 3/1988 Kulzer et al. ..... 206/477
5,988,381 A * 11/1999 Ling ..... 206/349
5,996,817 A * 12/1999 Kao ..... 211/70.6
6,186,323 B1 * 2/2001 Jansson et al. ..... 206/349
6,193,200 B1 * 2/2001 Kao ..... 248/309.1
6,241,208 B1 * 6/2001 Lin ..... 248/309.1
6,375,005 B1 * 4/2002 McCann ..... 206/349
6,378,700 B1 * 4/2002 Tong ..... 206/376
D486,381 S * 2/2004 Tsai ..... D8/373
6,732,989 B1 * 5/2004 Kao ..... 248/309.1

* cited by examiner

*Primary Examiner*—Kurt Fernstrom
(74) *Attorney, Agent, or Firm*—William E. Pelton, Esq.

(57) ABSTRACT

A suspension plate has a base plate, a U-shaped holding member and a locking stub. The base plate has a suspension hole defined near one end of the base plate. The holding member is formed on the base plate to define a chamber with two opening ends between the holding member and the base plate. A locking channel is defined in the base plate and has multiple first teeth formed on each respective side of the channel. The locking stub is inserted into the locking channel and has multiple second teeth formed on the protrusion to engage with the teeth on the locking channel so as to keep the protrusion from moving in reverse. Accordingly, a tool can be securely held in the suspension plate to keep the tool from being unauthorizedly removed.

7 Claims, 3 Drawing Sheets

SUSPENSION PLATE FOR A TOOL

BACKGROUND OF THE INVENTION

1. Field of the Invention

The present invention relates to a suspension plate, and more particularly to a suspension plate for a tool that can keep the tool from being unauthorizedly removed from the suspension plate.

2. Description of Related Art

A suspension board is used to bold a tool, such as a pair of pliers, for retail displaying. The conventional suspension board in accordance with the prior art comprises a base plate and a transparent cover. The cover is attached to the base plate to hold a tool in place between the base plate and the cover. A suspension hole is defined in the base plate, such that the suspension board can be hooked on a rack for displaying.

However, the conventional suspension board cannot hold the tool after the cover has been detached from the base plate. The tool held in the conventional suspension board must be stored in another container, tool case or the like. Thus, the use of the conventional suspension board is only used for displaying and is not versatile.

To overcome the shortcomings, the present invention tends to provide a suspension plate to mitigate and/or obviate the aforementioned problems.

SUMMARY OF THE INVENTION

The main objective of the invention is to provide a suspension plate for a tool that can keep the tool from being unauthorizedly removed from the suspension plate and has a capability for holding the tool. The suspension plate has a base plate, a U-shaped holding member and a locking stub. The base plate has a suspension hole defined near one end of the base plate. The holding member is formed on the base plate to define a chamber with two opening ends between the holding member and the base plate. A locking channel is defined in the base plate and has multiple first teeth formed on each respective side of the channel. The locking stub is inserted into the locking channel and has multiple second teeth formed on the protrusion to engage with the first teeth on the locking channel so as to keep the protrusion from moving in reverse. Accordingly, a tool with two bodies pivotally connected with each other can be securely held in the suspension plate to keep the tool from being unauthorizedly removed.

Other objects, advantages and novel features of the invention will become more apparent from the following detailed description when taken in conjunction with the accompanying drawings.

DETAILED DESCRIPTION OF PREFERRED EMBODIMENT

Figure 1:
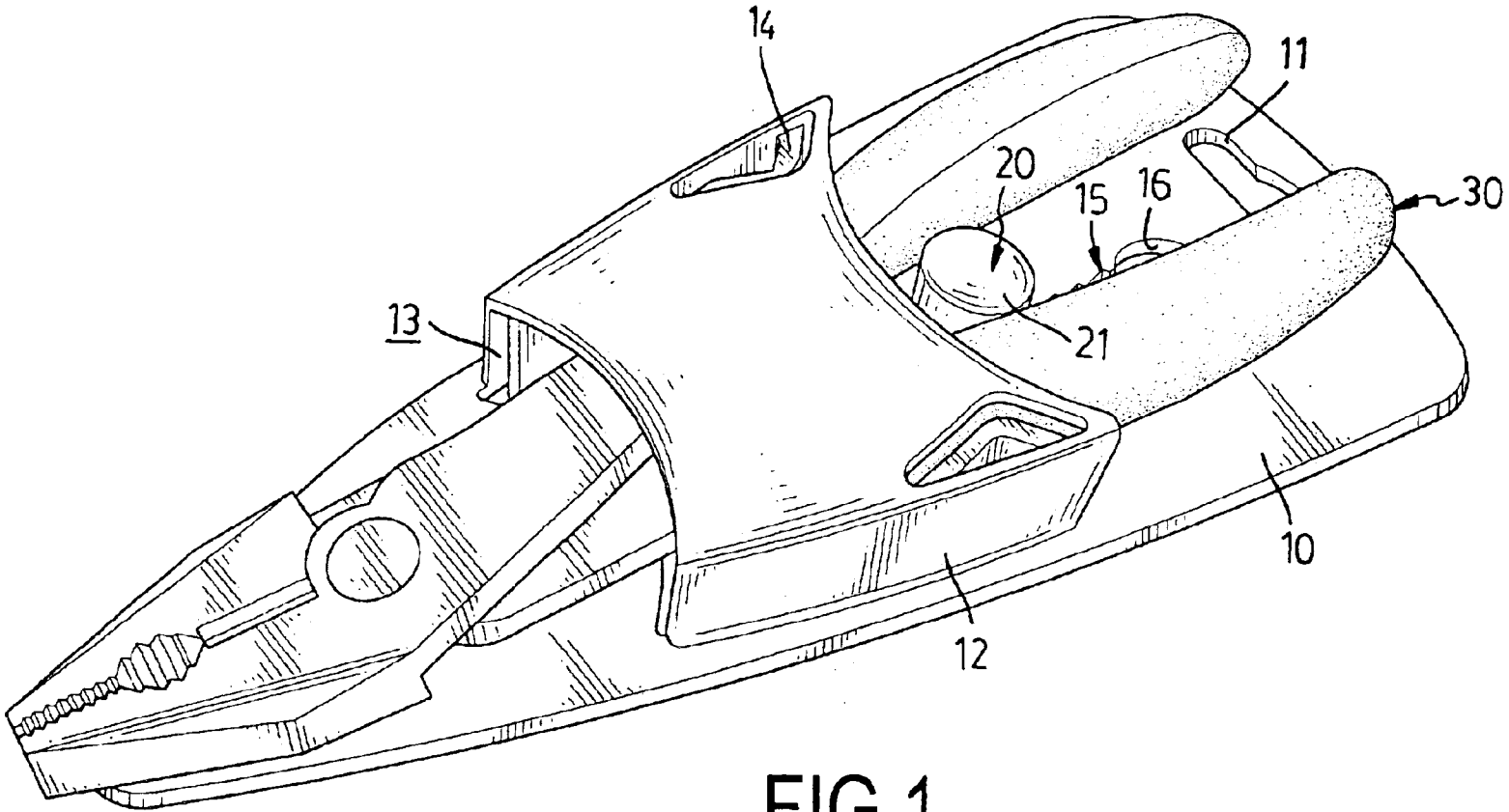
FIG. 1 is a view of a tool held in a suspension plate in accordance with the present invention.
Figure 2:
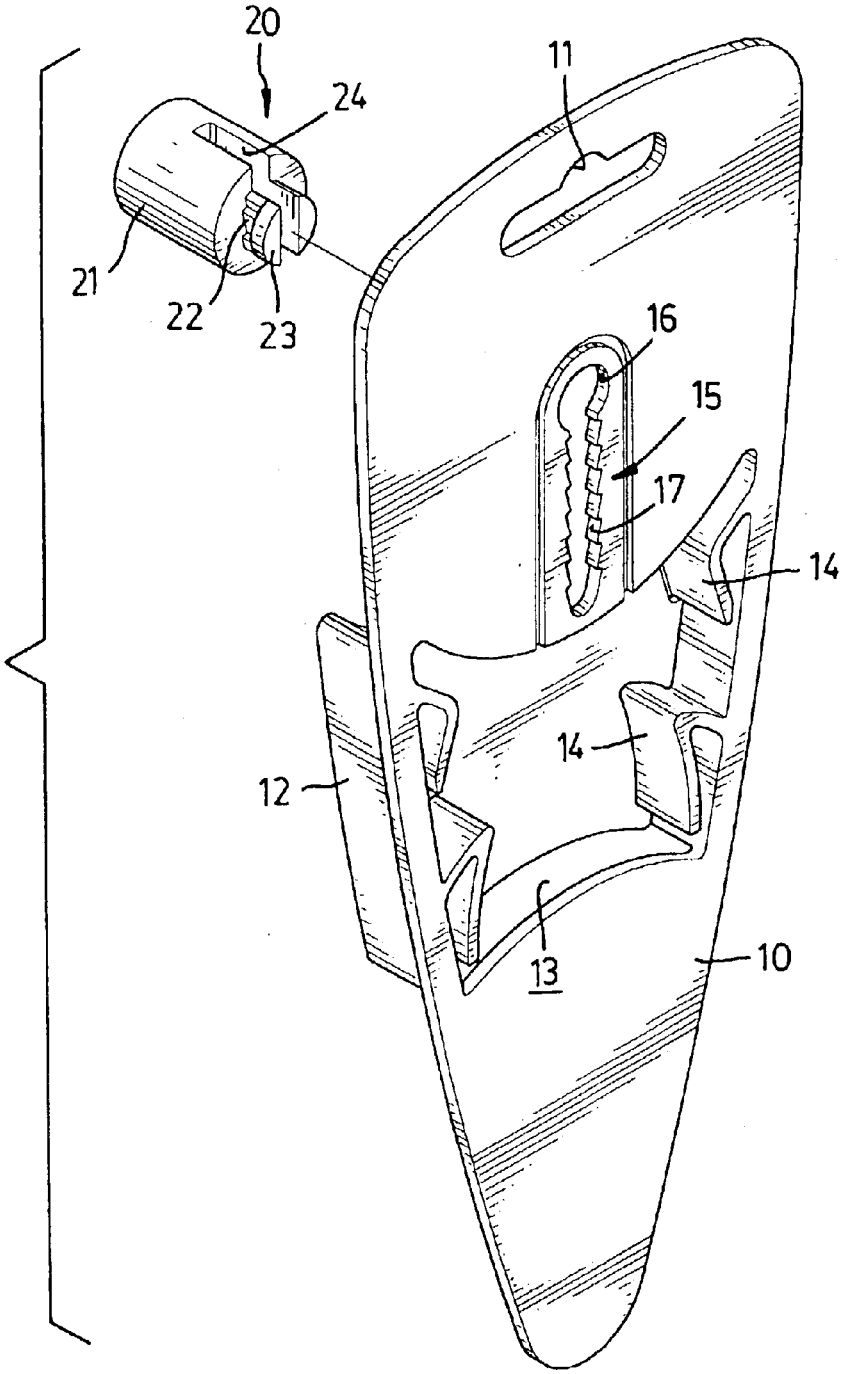
FIG. 2 is an exploded perspective view of the suspension plate in FIG. 1.

With reference to FIGS. 1 and 2, a suspension plate for a tool in accordance with the present invention comprises a base plate (10), a holding member (12) and a locking stub (20). The base plate (10) has a suspension hole (11) defined near one end of the base plate (10). A window (not numbered) is defined the side plate (??10) at a middle portion of the base plate (10).

The U-shaped holding member (12) is formed on the base plate (10) and corresponds to the window on the base plate (10), such that a chamber (13) with first and second opening ends is defined between the holding member (12) and the base plate (10) and communicates with the window. The holding member (12) has two side walls connected to the base plate (10) and a bridge connected between the side walls. The first opening end of the chamber (13) has a width larger than that of the second opening end. In practice, the first opening end of the chamber (13) faces to the suspension hole (11), and the second opening end is far away from the suspension hole (11). At least one inverse L-shaped elastic holding arm (14) is formed on each respective side wall of the holding member (12) and extends into the chamber (13).

A locking channel (15) with two sides, a first end and a second end is defined in the base plate (10) and between the suspension hole (11) and the first opening end of the chamber (13). Multiple first teeth (17) are formed on each respective side of the channel (15). A bore (16) is defined in the base plate (10) and communicates with the first end of the locking channel (15). The locking channel (15) has a width gradually decreasing from the first end to the second end.

The locking stub (20) is inserted into and held in the locking channel (15). The locking stub (20) has a body (21), a protrusion (23), a slit (24) and multiple second teeth (22). The body (21) is cylindrical, and the protrusion (23) protrudes from one end of the body (21). The slit is longitudinally defined through the protrusion and extends into the body (24) to make the protrusion (23) have an elastic capability. The second teeth (22) are formed on the protrusion (23) to engage with the first teeth (17) on the locking channel (15). The second teeth (22) are formed on the protrusion (23) near the conjunction between the body (21) and the protrusion (23), such that a head is formed on the free end of the protrusion (23).

Figure 3:
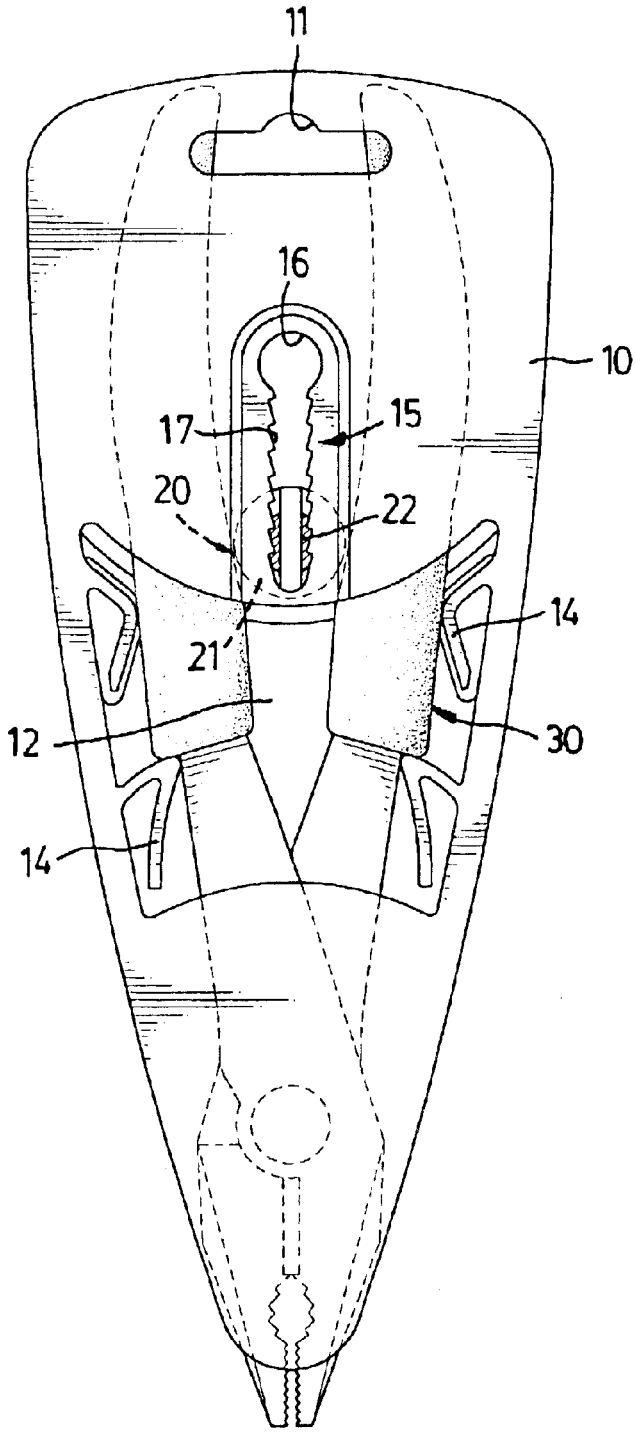
FIG. 3 is a rear side plan view of the tool held in the suspension plate in FIG. 1.

With further reference to FIG. 3, a tool (30) with two bodies pivotally connected with each other, such as a pair of pliers, can be inserted into the chamber (13) through the first opening end. Shanks of the tool (30) extend out the chamber (13) from the second opening end, and handles of the tool (30) are kept out from the first opening end of the chamber (13). With the narrow width at the second opening end of the chamber (13), the tool (30) will not completely penetrate through and will be held in the chamber (13). The holding arms (14) on the holding member (12) abut against the handles of the tool (30) to provide a further positioning effect to the tool (30).

Then, the protrusion (23) on the locking stub (20) is inserted into the bore (16) in the base plate (10), and the locking stub (20) is located between the handles of the tool (30). The locking stub (20) is moved along the locking channel (15), and the second teeth (22) on the protrusion (23) will engage with the first teeth (17) on the locking channel (15). With the elastic capability provide by the slit (24), the protrusion (23) will be compressed when the protrusion (23) slides from the wide first end of the locking channel (15) to the narrow second end, such that the second teeth (22) on the locking stub (20) will securely engage with the first teeth (17) on the locking channel (15). With the engagement of the teeth (17,22) on the locking channel (15)

and the locking stub (20), the locking stub (20) will be kept from moving backward along the locking channel (15). In addition, the head on the free end of the protrusion (23) of the locking stub (20) will abut against the base plate (10). Consequently, the locking stub (20) will be securely held in the second end of the locking channel (15). With the location of the locking stub (20) between the handles of the tool (30), the tool (30) will not be taken out from the chamber (13). This can keep the tool (30) from being removed from the suspension plate, and a theftproof effect is provided.

After the user buys the tool (30) with the suspension, the locking stub (20) can be removed from the locking channel (15) directly by means of cutting off the head on the protrusion (23) of the locking stub (20). Accordingly, the tool (30) can be taken out from the chamber (13) for use. The suspension plate can hold the tool again when the tool (30) is inserted into the chamber (13). With the suspension hole (11) in the base plate (10), the suspension plate with the tool (30) can be hung on a rack or on the wall. The suspension plate in accordance with the present invention not only can hold the tool (30) for display, but also can hold the tool (30) for use, thus the use of the suspension plate is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A suspension plate for a tool comprising:

a base plate having a suspension hole defined near one end of the base plate;

a U-shaped holding member formed on the base plate to define a chamber with a first opening end and a second opening end between the holding member and the base plate, and the holding member having two side walls connected to the base plate and a bridge connected between the side walls, wherein the first opening end of the chamber has a width larger than that of the second opening end;

a locking channel with two sides, a first end and a second end defined in the base plate and corresponding to the first opening end of the chamber, and the locking channel having multiple first teeth formed on each respective side of the channel; and a locking stub inserted into and held in the locking channel and having a body;

a protrusion with a diameter and a free end protruding from one end of the body and having a conjunction between the body;

a slit longitudinally defined through the protrusion to make the protrusion have an elastic capability; and multiple second teeth formed on the protrusion to engage with the first teeth on the locking channel so as to make the protrusion move along the locking channel in one direction only.

2. The suspension plate as claimed in claim 1 further comprising at least one elastic holding arm formed on each respective side wall of the holding member and extending into the chamber.

3. The suspension plate as claimed in claim 2, wherein each respective at least one holding arm is inverse L-shaped.

4. The suspension plate as claimed in claim 1, wherein the base plate has a window communicating with the chamber.

5. The suspension plate as claimed in claim 1 further comprising a bore defined in the base plate and communicating with the first end of the locking channel, wherein the bore has a diameter larger than that of the protrusion of the locking stub; and the locking channel has a width gradually decreasing from the first end to the second end.

6. The suspension plate as claimed in claim 1, wherein the second teeth are formed on the protrusion near the conjunction between the body and the protrusion so as to form a head on the free end of the protrusion.

7. The suspension plate as claimed in claim 1, wherein the first opening end of the chamber faces to the suspension hole in the base plate.

* * * * *